US006749443B2

(12) United States Patent
Sano et al.

(10) Patent No.: US 6,749,443 B2
(45) Date of Patent: Jun. 15, 2004

(54) SOCKET FOR MOUNTING AN ELECTRONIC DEVICE

(75) Inventors: Hideki Sano, Shizuoka (JP); Kiyokazu Ikeya, Shizuoka (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/313,272

(22) Filed: Dec. 6, 2002

(65) Prior Publication Data

US 2003/0114034 A1 Jun. 19, 2003

(30) Foreign Application Priority Data

Dec. 17, 2001 (JP) ..... 2001-382485

(51) Int. Cl.[7] ..... H01R 12/00
(52) U.S. Cl. ..... 439/71; 439/331
(58) Field of Search ..... 439/71, 330, 331, 439/68, 69, 70, 72, 73

(56) References Cited

U.S. PATENT DOCUMENTS 6,083,013 A 7/2000 Yamagishi
6,322,384 B1 * 11/2001 Ikeya ..... 439/331

OTHER PUBLICATIONS

Copending U.S. patent application Ser. No. 10/234,613, Kiyokazu Ikeya, filed Sep. 4, 2002, Socket for Removably Mounting Electronic Packages.

* cited by examiner

*Primary Examiner*—Ross Gushi
(74) *Attorney, Agent, or Firm*—Russell E. Baumann; Frederick J. Telecky, Jr.

(57) ABSTRACT

A socket (10) has a base member (20), a cover member (30) which is mounted for alternating motion toward and away from base member (20), a plurality of contacts (40) having an end fixed to the base member (20), a contact regulating member (50) that regulates the position of the movable ends (42, 92) of the contact and an adaptor (60) having a seating surface, the adaptor which is mounted for alternating motion toward and away from the contact regulating member (50). When adaptor (60) is removed from the contact regulating member, the movable ends of the contacts do not protrude through the seating surface and when adaptor (60) has been moved toward the contact regulating member (50), the movable ends of the contacts protrude from each through-hole (65) of adaptor (60) for engagement with the solder balls of a BGA device (11), placed on the adaptor (60). The cover member is linked to the base member and latches (70) having a BGA device pressing tip (72) are rotatable with movement of the cover. The latches have a first fulcrum (75) for a first segment of motion and a second different fulcrum (71) for a second segment of motion.

15 Claims, 10 Drawing Sheets

SOCKET FOR MOUNTING AN ELECTRONIC DEVICE

FIELD OF THE INVENTION

This invention relates generally to a socket for mounting an electronic device such as a semiconductor device, or the like, and more particularly to a socket which is to be used in burn-in tests for such devices.

BACKGROUND OF THE INVENTION

Defects in a semiconductor device are initially checked by subjecting the semiconductor device (which may be referred to as an IC device or an IC package) to a burn-in test. In connection with a burn-in test, the semiconductor device is mounted on or in a socket. According to sockets of the pop-up type which are widely used, a cover member of the socket engages in alternating motion in a direction toward and away from the main base thereof. This type of straight-line movement of the cover member is suitable for automatic loading of a semiconductor device.

The surface-loading type semiconductor devices in which a plurality of terminals are arranged in an X-Y matrix as in the case of BGA (ball grid array) or CSP (Chip Sized Package) are increasing in number, and sockets which can be used for these are being developed. In the case where a BGA package or a CSP package is mounted on a circuit substrate, there may be problems of defective soldering stemming from irregularities in the height of the balls or the deformation of one or more balls. It is desirable that the lower surface (the loading side) of the ball be free of damage. In the case where the ball is made of a low melting point substance such as solder, etc., there are cases where it tends to be softened in the high temperature state at the time of a burn-in test, with the solder balls becoming deformed.

In order to avoid such a problem, as shown in U.S. Pat. No. 6,083,013, issued Jul. 4, 2000, one approach provides a contact terminal which regulates the amount of contact protrusion from a floating member which seats an IC device at the end of the contacts, thereby leveling the protrusion heights of the solder balls.

Nevertheless, there is the following problem in this approach: With reference to FIG. 12, a floating member 2, capable of vertical movement relative to the main socket body 1, is provided with a stop mechanism for regulating the amount of protrusion of the contact end. Because of this, contact terminals 6 protrude from floating member 2 at all times including the time of loading of IC package 4, with solder balls 3 of the IC package 4 being in contact with the contact terminals 6. As a result, solder balls 3 can be caught by the contact terminals 6 thereby interfering with loading of the IC package. Further, it is impossible for the IC package to be loaded in the socket without a possibility that at least some solder balls 3 are scraped during the loading procedure.

SUMMARY OF THE INVENTION

An object of the present invention is the provision of a socket which overcomes the above noted prior art limitation and which properly loads semiconductor devices of the surface loading type such as BGA or CSP.

Another object of the invention is the provision of a socket which is capable of controlling any deformation of a protrusion-like or a bump-shaped terminal of a semiconductor device to be loaded. Still another object is the provision of a socket in which the amount of deformation of the terminals of semiconductor devices of the surface loading type can be adjusted.

Yet another object of the invention is the provision of a socket having a latch mechanism having improved operability, is economical and which is suitable for automatic loading of semiconductor devices.

According to the invention, contact regulating means for the regulation of the position of the movable ends of a plurality of contacts is provided in a socket comprising a base member, a cover which is mounted for alternating motion toward and away from the base member, a plurality of contacts that have been fixed to the base member body and an adaptor for seating the electronic device. The contact regulating means is provided on the base member and the adaptor is movably mounted on the contact regulating means. A plurality of through-holes are formed in the adaptor in conformity with the plurality of contacts and, when the adaptor has been moved toward the contact regulating means, the movable ends of the contacts protrude from the through-holes of the adaptor. Since the movable ends of the contacts are regulated to a certain fixed protrusion height by the contact regulating means, the protrusion height of the movable ends of the contacts that protrude from the adaptor is also regulated. When the adaptor touches the contact regulating means, the amount of protrusion of the movable ends of the contacts from the seating surface of the adaptor is maximized. When the adaptor is disposed at a position which is removed from the contact regulating means, the plurality of free ends of the contacts are positioned inside the through-holes without protruding from the seating surface of the adaptor.

Preferably, the contact regulating means has a plurality of slots at locations corresponding to the plurality of contacts, with a stop surface being formed in each slot to engage with or near the movable end of the contacts, thereby making it possible to regulate the protrusion height of the movable ends of the contacts.

Preferably, the adaptor can be removed from the socket and replaced with another adaptor so that the amount of protrusion of the free movable end of the contacts can be varied. In addition, the seating surface of the adaptor may include an offset surface for supporting the electronic device, and a surface which includes the plurality of through-holes at a location which is lower than the offset surface. The electronic device is a semiconductor device having a plurality of terminals arranged on one side in an X-Y matrix, such as BGA or CSP types.

Moreover, the socket made according to this invention may include a latch member that moves in linkage with the cover member. The latch member is linked to the cover member through a linkage mechanism and, when the cover member is separated from the base member, the electronic device (semiconductor device) is pressed down, thereby causing the adaptor to be pushed down. When the adaptor has been pushed down more than a certain amount, the movable end of the contacts protrude from the through-holes of the adaptor (seating surface of the adaptor), effecting contact with the terminals.

According to a feature of the invention, the latch member is rotated using first and second fulcrums changing the radius of rotation or straight-line distance between the center of the rotation and the pressing part of the latch member. The arrangement provides a rapid movement of the latch member to its retracted location using one fulcrum when the cover member has been pushed down and when the cover is allowed to ascend, back to a position where the latch engages a semiconductor device loaded in the socket. From this location, using the other fulcrum, more gradual movement is effected as the cover member is pushed up, thereby gradually increasing the pressing force that is given to the semiconductor device. As a result of this, it becomes possible to prevent any damage or deformation, particularly to thin semiconductor devices.

BRIEF DESCRIPTION OF THE DRAWINGS

The accompanying drawings, which are incorporated in and constitute a part of the specification, illustrate preferred embodiments of the invention and, together with the description, serve to explain the objects, advantages and principles of the invention. In the drawings.

DETAILED DESCRIPTION OF PREFERRED EMBODIMENTS

Figure 1:
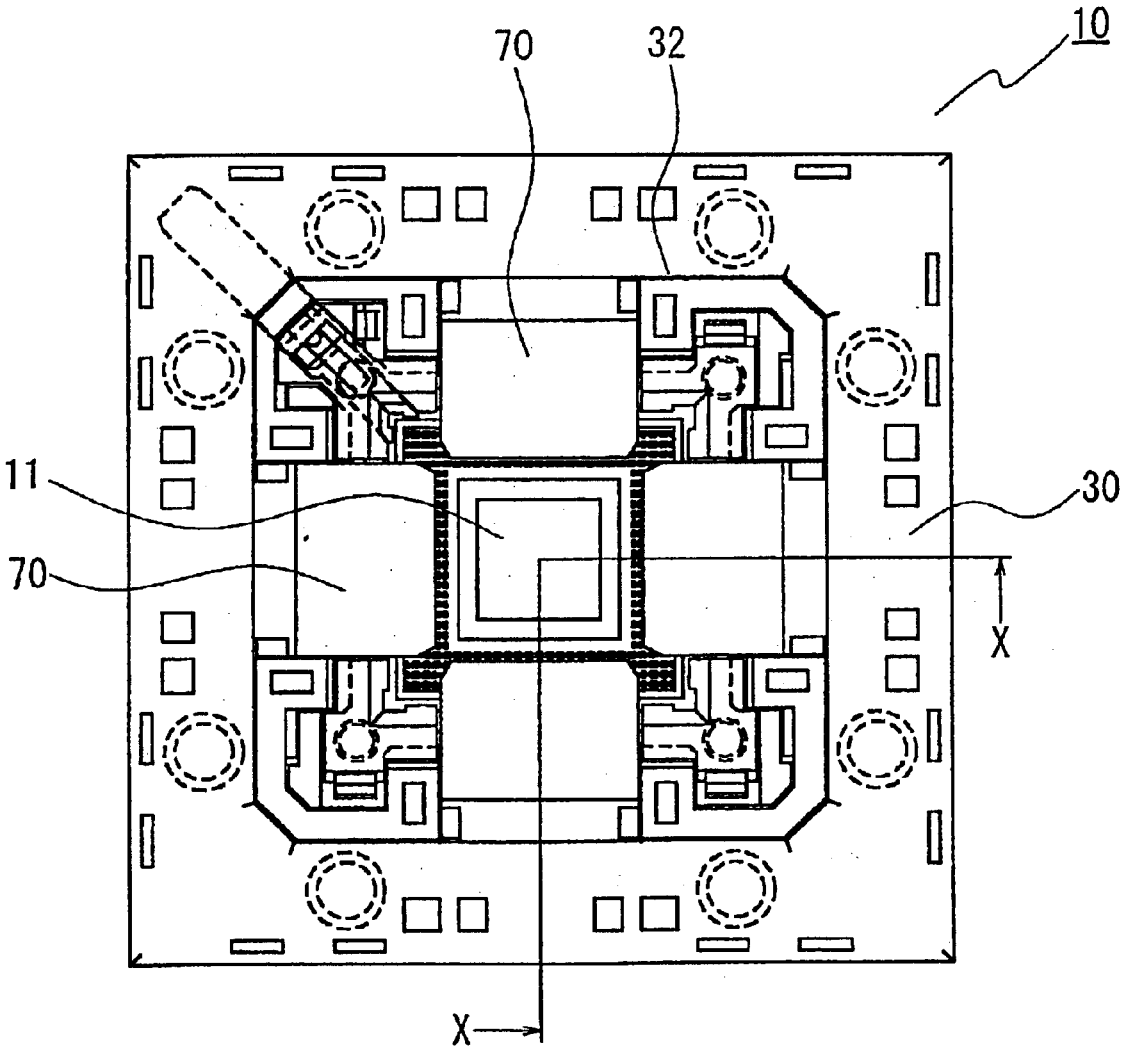
FIG. 1 is a top plan view of a socket made according to a first preferred embodiment of the invention.

Socket 10 made according to the first preferred embodiment has been developed for semiconductor devices of the BGA type. One type of BGA device 11 has ball-shaped terminals 12 (see FIG. 4) comprising a solder material of low melting point (solder balls) arranged in an X-Y matrix. A solder ball 12 has a diameter of approximately 0.3 millimeters and protrudes from the lower surface of the package by approximately 0.25 millimeters. The overall height of the BGA device is approximately 1.2 millimeters.

Socket 10 comprises a base member 20, a cover member 30 that is capable of alternating motion in a direction moving toward and away from the base member 20, and a plurality of contacts 40 that have been mounted on base member 20. Base member 20 is typically formed by injection molding of suitable material such as high heat resistant resin polyether sulfone (PES), with a plurality of holes 21 being formed approximately at its center for the purpose of mounting contacts 40. Each hole corresponds to the position of a solder ball 12 of a BGA device loaded in the socket and extends from the bottom to upper surface 20*a* of base member 20. Surface 20*a* where the hole 21 has been formed is in a recess formed in wall portion 23. Other high heat resistant resins, which can be used, include PEI or PAI.

Figure 7A:
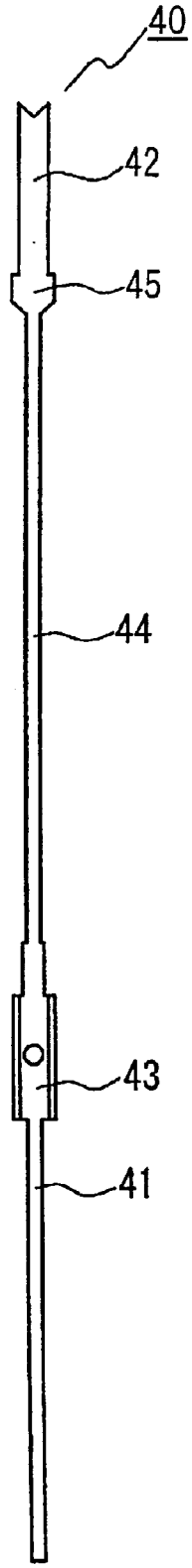
FIGS. 7(*a*) and 7(*b*) are front and side elevational views, respectively, of a terminal engaging contact.
Figure 7B:
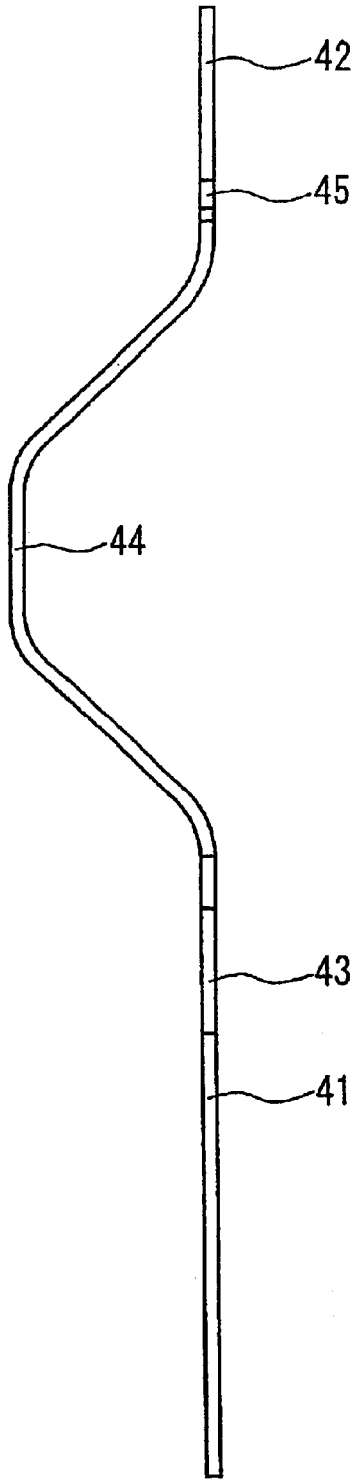

With reference to FIGS. 7(*a*), 7(*b*), contacts 40 are formed by punching a suitable metal sheet such as a beryllium copper sheet. One end 41 of contact 40 when mounted in a hole 21 of base member 20 is a fixed end which extends out beyond the bottom of the base member and is suitably connected to an electrically conductive contact of a circuit substrate (omitted in the figure) with solder, or the like. The opposite end 42 is a movable end for connection to a respective solder ball 12 of a loaded BGA device 11. An expanded width portion 43 is formed on contact 40 near end 41 for engaging the wall of a respective hole 21 of base member 20 and a curved elastically deformed part 44 is formed between ends 41 and 42. The elastically deformed part 44 produces a spring member which accommodates compression in the axial direction of contact 40 and provides desired contact force between end 42 and solder ball 12. Another expanded width part 45 is formed between the elastically deformed part 44 and end 42 for engagement with a stop surface 54 of the contact regulating member 50, as will be described later. End 42 of the contact has a V-shaped groove for preventing any deformation of the lowermost part of solder ball 12 when solder ball is engaged with end 42.

Figure 2:
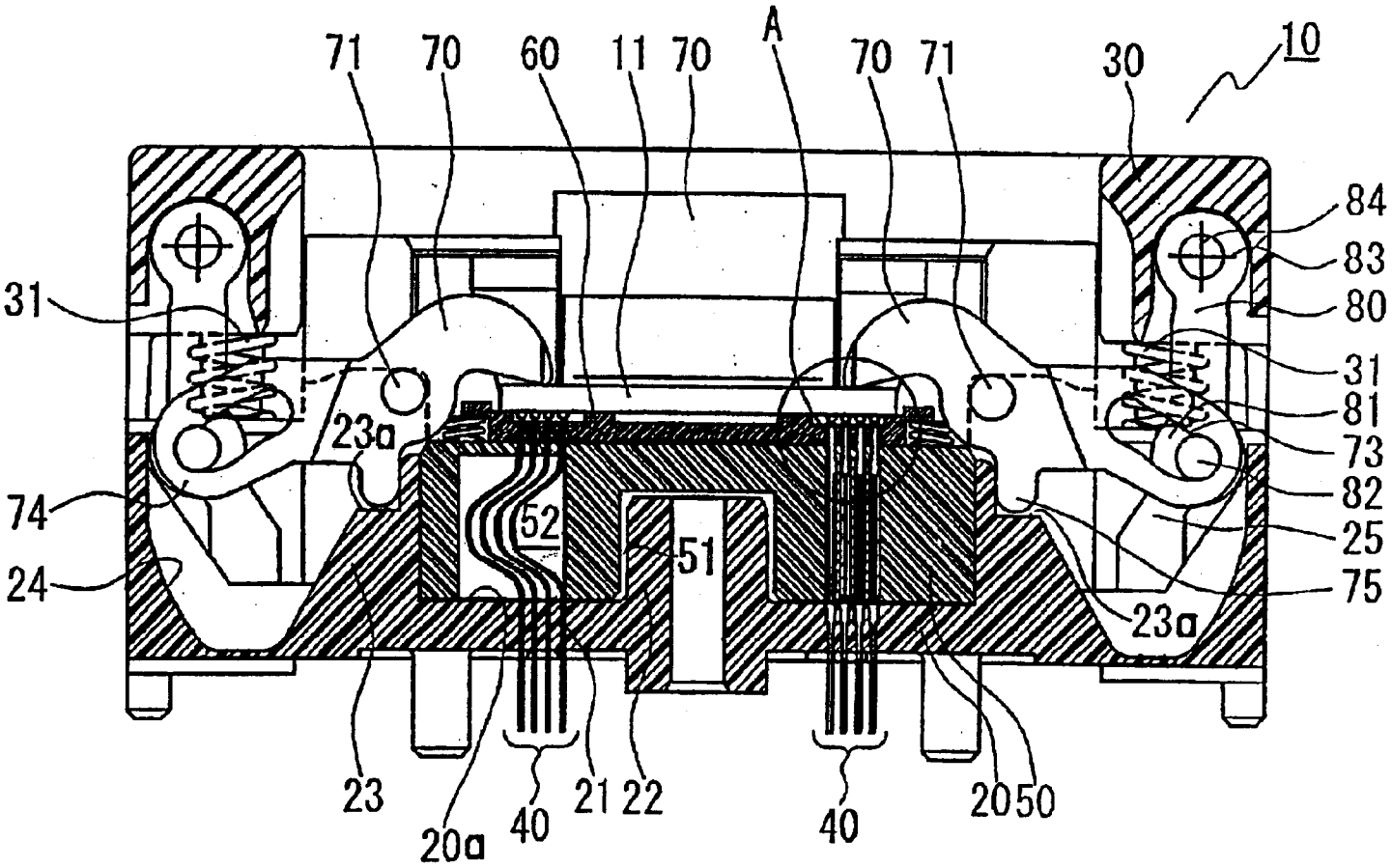
FIG. 2 is a cross sectional view taken on line X—X in FIG. 1, showing the state where the cover member is in the normal, raised position with a BGA device loaded therein.
Figure 3:
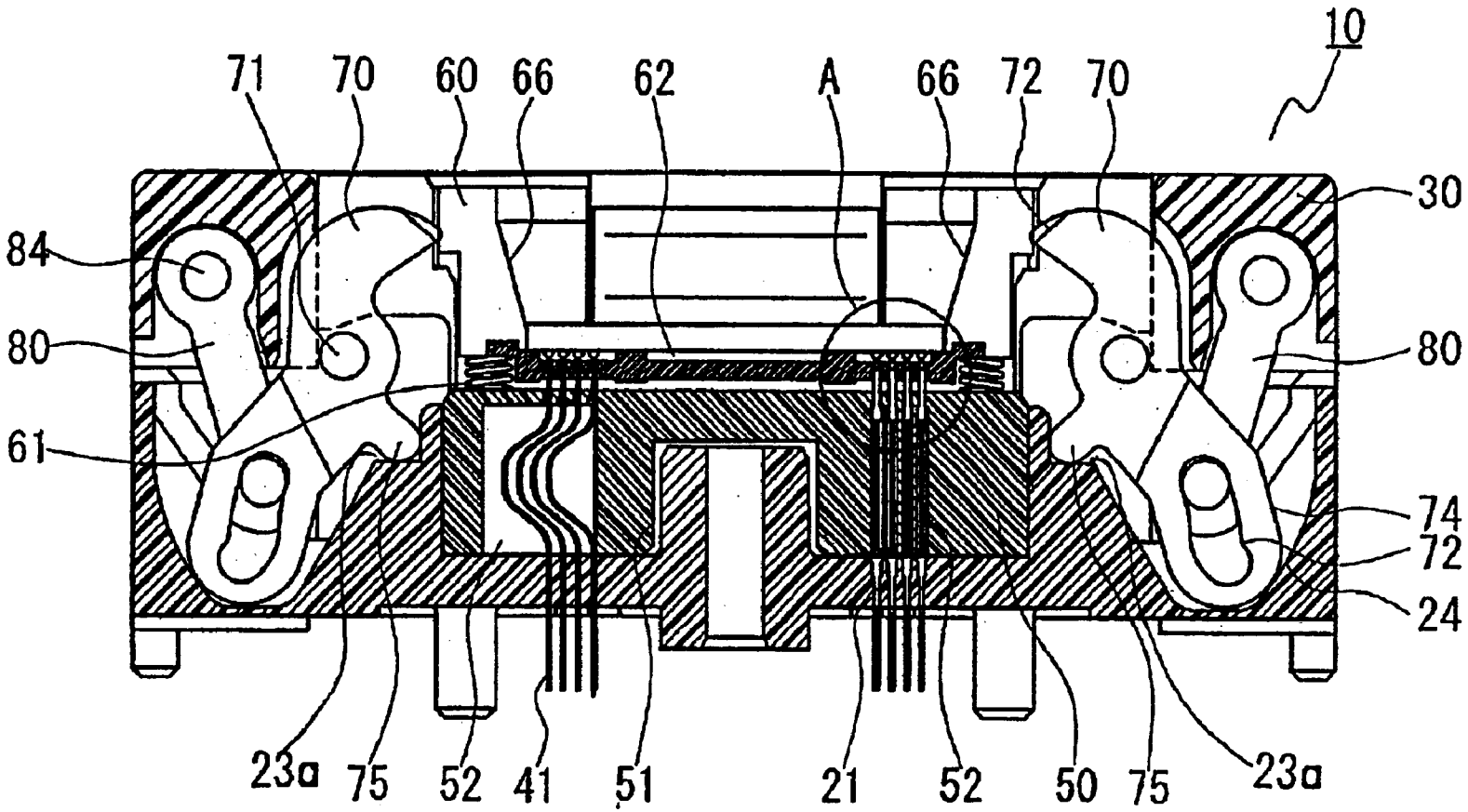
FIG. 3 is a cross sectional view taken on line X—X in FIG. 1, showing the state in which the cover member has been pushed down, with a BGA device placed therein.
Figure 4:
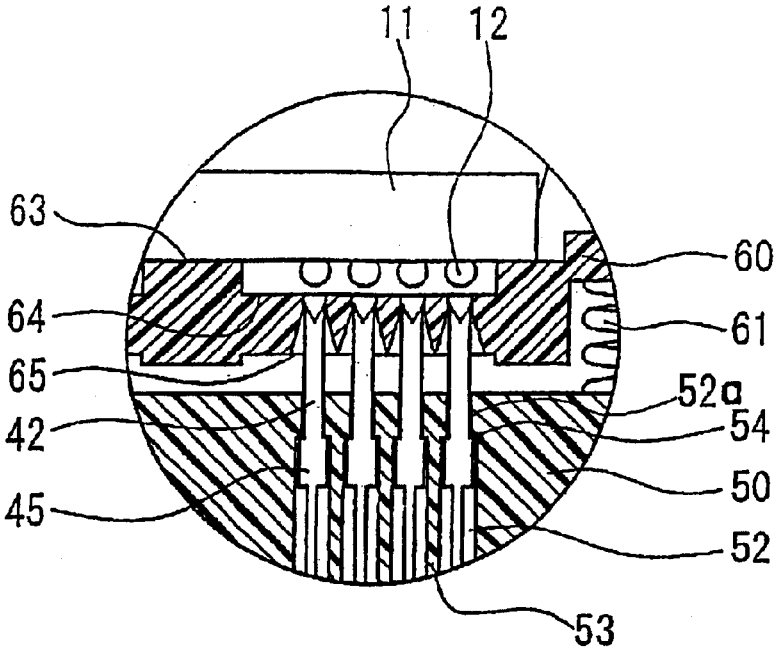
FIG. 4 is an enlarged view of part A in FIG. 3.

Contact regulating member 50 can be formed by injection molding of the same material as the base member and has a recess in the bottom thereof to accommodate hub 22 protruding above surface 20*a*. A plurality of vertically extending slots 52 are formed in regulating member around recess 51, at locations which correspond to respective holes 21 of base member 20. Each slot 52 is formed by a partition of the insulating partition wall 53 as is shown in FIGS. 2, 3 and 4, extending from the bottom through to contact tip receiving apertures 52*a* in the upper wall of contact regulating member 50. The distance between the insulating partition walls 53 or the width of the slot 52 is constant at somewhat larger than the width of contact 40; however, it becomes smaller in the upper wall at aperture 52*a* at the upper surface, thereby forming a stop surface 54. When contact 40 is received inside slot 52, the wide engagement part 45 stops at the stop surface 54. Because of the above, the distance that contact 40 protrudes above the upper surface of the contact regulating member 50 is regulated constant at all times.

In the described embodiment, four contacts 40 are arranged in each slot 52 of the contact regulating member 50 (see FIGS. 2, 3). In the following description, reference will be made to an individual contact 40 which is intended to apply to the other contacts 40 as well. By stopping each engagement part 45 at one end of contact 40 at stop surface 54 and then, stopping the wide part 43 at the opposite end of contact 40 in each hole 21, contact regulating member 50 is mounted on base member 20. One end of contact 40 is stopped in one direction by the wide part 43 at each hole 21. The other end 42 of contact 40 is stopped by the engagement part 45 at stop surface 54 of slot 52. Thus, a certain preload is added to the elastically deformed part 44 of contact 40.

An adaptor 60 is installed on the top surface of contact regulating member 50 movable toward and away from the regulating member. A coil spring 61 is interposed between the two at each corner, thereby providing a spring force causing a separation of adaptor 60 from contact regulating member 50. A pair of hooks (omitted in the figure) is provided on both sides of adaptor 60. Movement of the adaptor away from the regulating member is limited by engagement of the hooks with engagement parts (omitted in the drawings) of the base member 20, thereby causing the adaptor 60 to normally be positioned removed or away from the contact regulating member 50 at the hook limited position.

Adaptor 60 has a seating surface 62 for placing BGA device 11. The seating surface 62 has a raised offset surface portion 63 for supporting the lower face of BGA device 11 and a surface 64 which is one step lower, with a plurality of through-holes 65 formed therethrough for guiding the protruding end 42 of contact 40 (see FIG. 4). The plurality of through-holes 65 corresponds to the positions of the slots 52 of contact regulating member 50. An erect guide 66 which includes an inclined surface is formed around the seating surface 62 of adaptor 60 to guide BGA device 11 onto seating surface 62.

Figure 5:
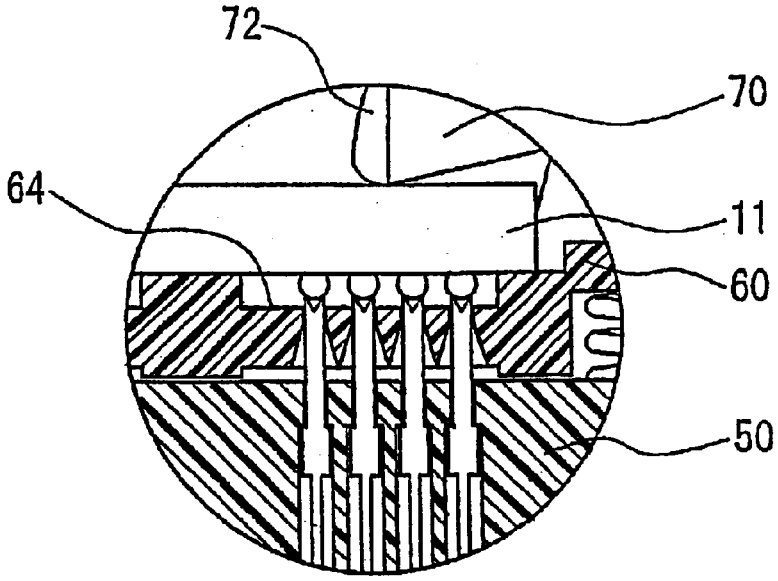
FIG. 5 is similar to FIG. 4 and shows the FIG. 2 state in which the movable terminal engaging ends of the contacts have engaged with respective solder balls.

When adaptor 60 is in the maximum separated position relative to regulating member 50, there is a certain distance (refer to FIG. 4) between the adaptor 60 and the contact regulating member 50. In this position, end 42 of the contact is located within through-hole 65 without protruding from the lower surface 64. When a force which is greater than that of springs 61 has been applied to adaptor 60, the adaptor moves down in opposition to coil springs 61 and, as shown in FIG. 5, end 42 of each contact is guided by the wall of through-hole 65 and protrudes out beyond seating surface 64. In one preferred embodiment, the adaptor 60 can move down until it touches the contact regulating member 50 (see FIG. 6).

Adaptor 60 can be taken out of the socket as the pair of hooks that were described earlier are disengaged from the engagement part of the base member, and another adaptor can be substituted in conformity with a particular IC package to be loaded (such as the number of terminals and the size of the ball of solder or the size and thickness of the package). In other words, one single socket can be made to accommodate various kinds of IC devices by merely exchanging the adaptor. For this purpose, it is desirable to prepare many kinds of adaptor 60. For example, a plurality of those whose thicknesses are different by 0.01 millimeter each are prepared so that the distance between the contact regulating member 50 and the adaptor 60 may be adjusted by increments of 0.01 millimeter and, when the adaptor 60 has touched the contact regulating member 50, the protrusion height of end 42 of the contact from the adaptor can be modified. In other words, the amount of deformation of the solder ball 12 can be controlled.

A downwardly extending post is formed at each corner of cover member 30 and this post is inserted into a complimentary hole (omitted in the drawing) formed at each corner of the base member 20. Coil springs 31 are interposed between cover member 30 and base member 20, biasing cover member 30 away from base member 20. A pair of hooks (not shown in the drawing) is provided on cover member 30 and, when said hooks have been engaged with base member 20, cover member 30 is at the maximum removed position from base member 20. A generally rectangular opening 32 is formed approximately at the center of cover member 30 and a BGA device 11 is placed on seating surface 62 along guide 66 of adaptor 60 through opening 32.

Four latch members 70 are installed around adaptor 60 freely rotatable on base member 20 by means of rotary shafts 71, with the tips (force application parts) 72 at each side of base member 20 maintaining an orientation in parallel with the terminal face of the adaptor 60. A description of one latch member and its associated components will apply to the other latch members. As shown in FIGS. 2 and 3, a link 80 is arranged at the opposite end of latch member 70 from tips 72. One end 81 of link 80 is connected to a transversely extending shaft 82 which is received through an elongated slot 73 in latch member 70. The other end 83 of link 80 is freely rotatably supported in cover member 30 by a shaft 84. The outer periphery of the end of latch member 70 in which slot 73 is formed has an arc-shaped outer peripheral surface 74 and, when shaft 82 of the link moves upon movement of cover 30, the arc-shaped outer peripheral surface 74 slides on the cam surface 24 formed in a recess of base 20 and shaft 82 slides in slot 73 causing rotation of latch member 70. A protrusion-like fulcrum 75 is provided on latch member 70, with said fulcrum 75 being engaged with step 23*a* of base member 20 and it serves as a first center of the rotation providing a first selected radius of rotation when latch member 70 is rotated from a location where engagement with a BGA device 11 would initially occur toward and away from the retracted position.

As cover member 30 moves toward the base member 20 from the location where engagement with the BGA devices ceases, in opposition to springs 31, link 80 moves down and latch member 70 starts to rotate in a first segment of motion with fulcrum 75 as the center due to movement of shaft 82 in slot 73. At the same time, the arc-shaped outer peripheral surface 74 engages cam surface 24 with link 80 rotating with shaft 84 as the center and the force application part 72 of member 70 moves away from seating surface 62 of adaptor 60. When cover member 30 has been pushed down by a full stroke, or at least by a sufficient amount, the force application part 72 of latch member 70 is moved into a retracted position where it does not interfere with the insertion of a BGA device 11.

Next, the action involved in the loading of a BGA device in the present embodiment will be explained. When cover 30 is in the depressed position, a BGA device 11 is placed on seating surface 62 through opening 32 of cover member 30. BGA device 11 is regulated by guide 66 of adaptor 60 and adaptor 60 is in the position removed from regulator member 50 by coil springs 61, with a consequence that end 42 of each contact whose position is being regulated by the contact regulating member 50 is located within a through-hole without protruding from the seating surface 64 of the adaptor (see FIG. 4). When BGA device 11 is placed on seating surfaces 63 and 64 of the adaptor, therefore, there will be no contacting of solder balls 12 with ends 42 of the contacts with a consequence that BGA device 11 will be properly seated on the adaptor with no danger of scratching any solder balls 12.

Figure 6:
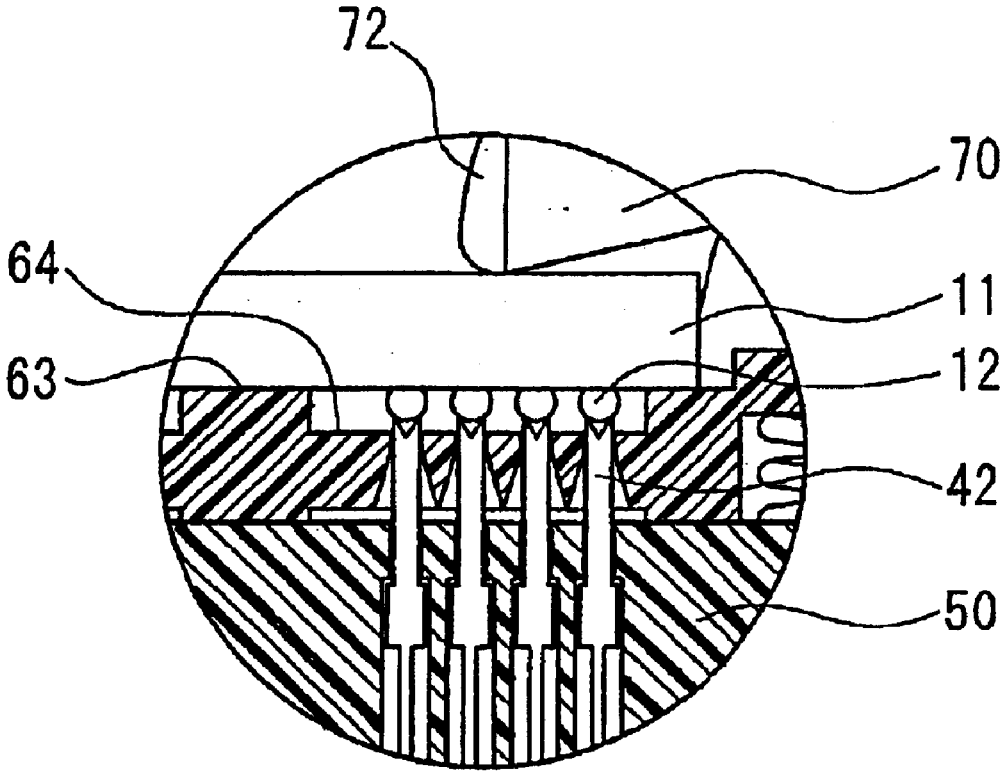
FIG. 6 is similar to FIG. 4 and shows the state of engagement between the movable end of the contacts and respective solder balls when the adaptor has engaged the contact regulating member.

Subsequent to placing of the BGA device 11 on adaptor 60, if the force that is being exerted on the cover member 30 is gradually reduced, cover member 30 will move away from base member 20 by the force of springs 31. One end 81 of each link 80 starts its rotation moving from the socket center toward the outside, and tip 72 of the latch member 70 moves from the retracted location toward BGA device 11 on adaptor 60. It should be noted that when cover member is in the normally separated position from the base member and with no semiconductor device at the seating surface, tip 72 of latch 70 either touches surface 62 of adaptor 60 or it is located at a position only slightly away from it. Thus, with BGA device 11 received on the seating surface, eventually, the tip (force application part) 72 engages the upper surface of BGA device 11. As the cover member continues to ascend, latch member 70, in a second segment of motion, starts a rotation with shaft 71 in engagement with a surface of the cover member which becomes the second center of rotation having a second different selected radius of rotation and with fulcrum 75 moved away from step 23*a* of base member 20. Although adaptor 60 is normally biased away from base member 20 by coil springs 61, a greater force is applied to GBA device 11 through tip 72 of latch member 70, with a result that the adaptor 60 moves toward contact regulating member 50. When the adaptor moves down by a certain distance, ends 42 of contact 40 protrude from the seating surface 64 of adaptor 60 through through-holes 65 and engage respective solder balls 12 (see FIG. 5). Latch member 70 rotates with shaft 71 as the center, thereby pushing down the BGA device to a point where a balance is struck between the spring force of coil springs 31 that are urging the cover member upwardly and the contact force of contacts 40 or until adaptor 60 touches the contact regulating member 50 (see FIG. 6). Each contact 40 produces a contact force in conformity with the amount of downward movement of the contacts through tip 72 of latch member 70 and, when contact 40 is in the state of being balanced with the spring force of the springs 31, there is produced some clearance between adaptor 60 and contact regulating member 50 or, when adaptor 60 has touched contact regulating member 50 as shown in FIG. 6, the engagement part 45 of the contact will be in a state where it is slightly separated from stop surface 54.

Regarding the distances between tip 72 of latch member 70 that serves as a point of action and rotary axis 71 that is the second center of rotation and fulcrum 75 that is the first center of rotation, the first selected radius of rotation (fulcrum 75) is greater than the second selected radius of rotation (fulcrum 71). In other words, when BGA device 11 is pressed down by the tip 72, a comparatively greater force with less movement is produced in conformity with this principle when the rotary shaft 71 is used as the center rather than when the fulcrum 75 is used as the center. On the other hand, when tip 72 of latch member is shifted from the position enabling engagement of tip 72 with a BGA device to the retracted location, it becomes possible to rotate the latch member 70 at a comparatively high rate, thereby reducing the stroke of the cover member 30 when fulcrum 75 is used as the center rather than when the rotary shaft 71 is used as the center. By employing a latch member which is equipped with two such fulcrums, it becomes possible to reduce the downward force of the cover member and make the outside size of the socket smaller.

In the burn-in test, a socket 10 with a BGA device 11 loaded thereon is put into an oven and a heat-resistance test for the BGA device is carried out. During the course of the heat-resistance test, when the solder ball 12, composed of a low fusion point metal, softens and end 42 of the contact gradually deforms solder ball 12, the engagement part 45 of the contact comes into engagement with stop surface 54 from the state shown in FIG. 6 and the solder ball is deformed by the amount of the shift of the contact. The maximum protrusion height of end 42 of the contact from seating surface 64 is restricted by the engagement of adaptor 60 with contact regulating member 50, so that solder balls 12 will not be deformed beyond the maximum protrusion height. The maximum amount of deformation of solder balls 12 is determined by the clearance (distance) between adaptor 60 and contact regulation member 50 when solder ball 12 has engaged end 42 of the contact. By adjusting this clearance, it becomes possible to control the amount of deformation of the solder ball. In this embodiment, by preparing the adaptors of different thicknesses at increments of 0.025 millimeters as described above, the amount of the deformation of the solder ball 12 can be controlled to 0.025 millimeters.

Next, the second preferred embodiment of the invention will be explained. In the first embodiment, the rotation of the latch member stops when adaptor 60 engages contact regulating member 50. In the second embodiment, on the other hand, the force application position of tip 72 of the latch member 70 is prevented from going down further than a certain point. The lowest pressing point of latch member 70 can be regulated by changing the dimensions of the latch member or by controlling the return position of cover member 30.

Figure 8:
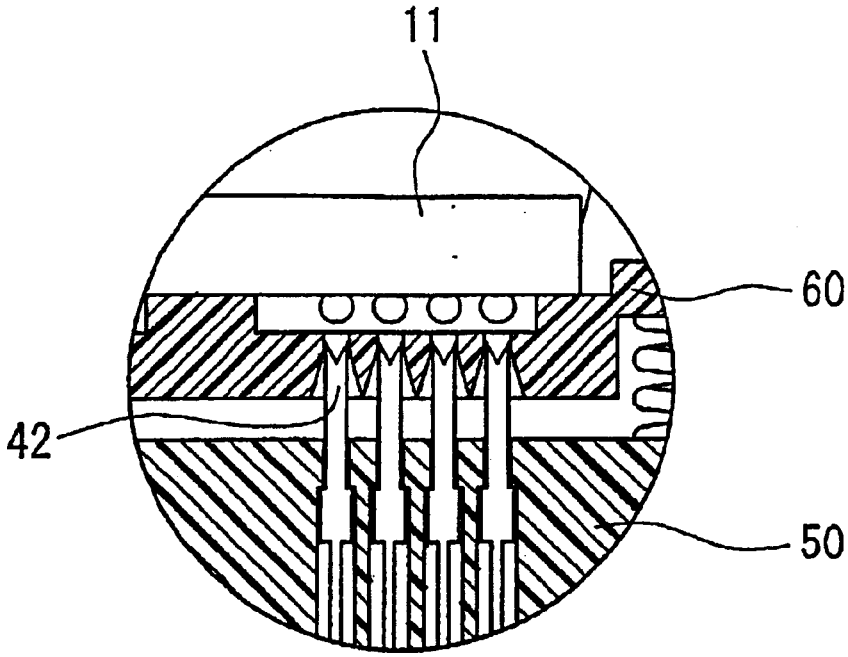
FIG. 8 is similar to FIG. 4 and illustrates a second embodiment of the invention, indicating the state in which the BGA device has been seated on the adaptor.
Figure 9:
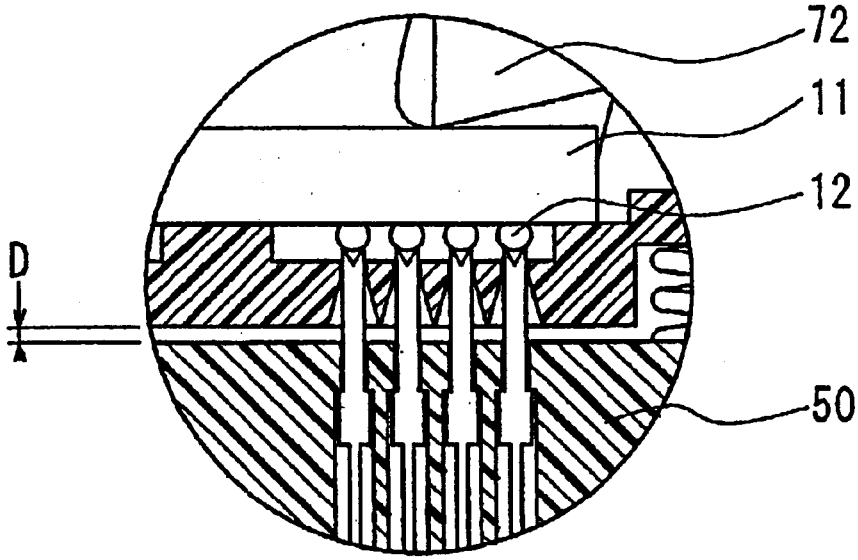
FIG. 9 is similar to FIG. 8 and shows the state in which the tip of the latch member has engaged the BGA device.
Figure 10:
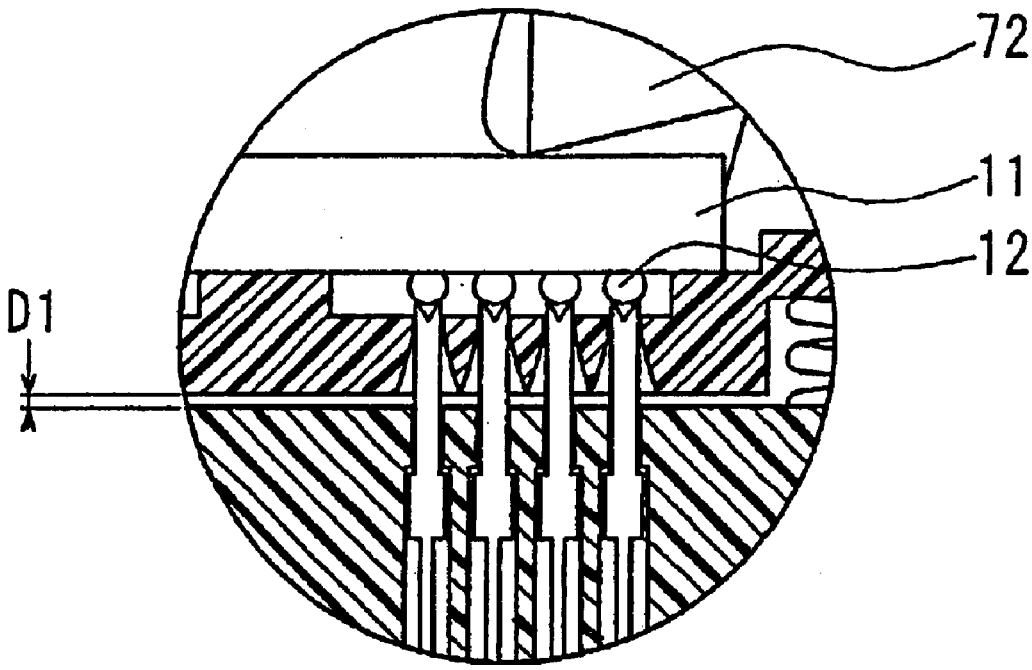
FIG. 10 is similar to FIG. 8 and shows the state in which the rotation of the latch member has stopped.

FIG. 8 shows the state in which BGA device 11 has been seated on the adaptor 60. FIG. 9 shows the state where the tip 72 of the latch member has engaged the BGA device. FIG. 10 shows the state in which the latch member has stopped at the lowest force application point. The states shown in FIGS. 8 and 9 are no different from the case involving the first embodiment. When tip 72 of the latch member engages the upper surface of BGA device 11, a certain clearance D is produced between the adaptor 60 and the contact regulating member 50. Thereafter, cover member 30 moves further up and latch member 70 also rotates; however, the rotation of latch member 70 stops at the position where the clearance D1 between the adaptor 60 and the contact regulating member 50 is produced (see FIG. 10). Contact 40 bends by the downward pressing of latch member 70, and engagement part 45 is at a position which is away from stop surface 54. Adaptor 60, too, is in a floating state without engaging contact regulating member 50. Thus, it becomes possible to prevent the pressing force from latch member 70 to BGA device 11 from becoming larger than is required.

Figure 11A:
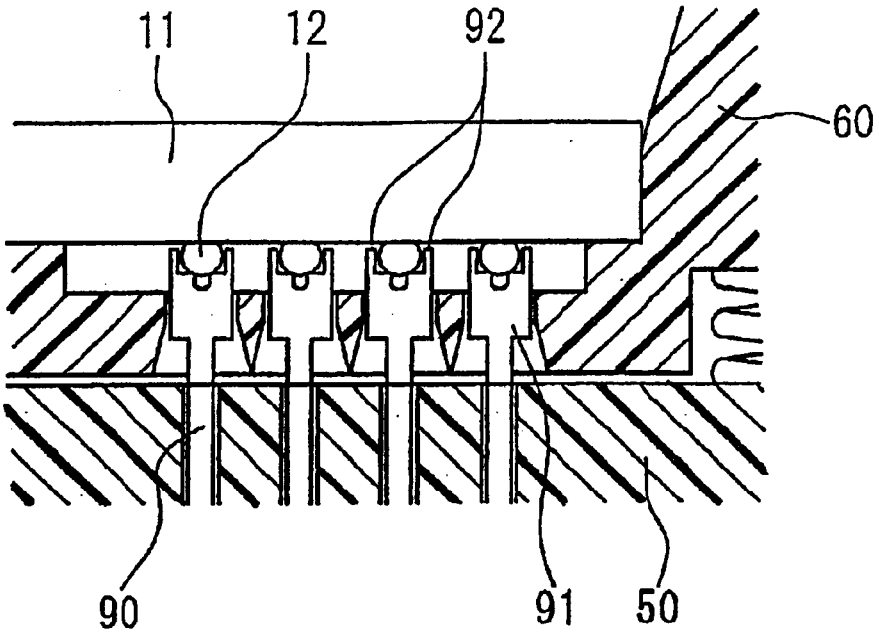
FIGS. 11(*a*) and 11(*b*) illustrate another preferred embodiment in which FIG. 11(*a*) shows the state in which the BGA device has engaged the movable end of the contacts and FIG. 11(*b*) shows the state during which the BGA device is placed on the adaptor.
Figure 11B:
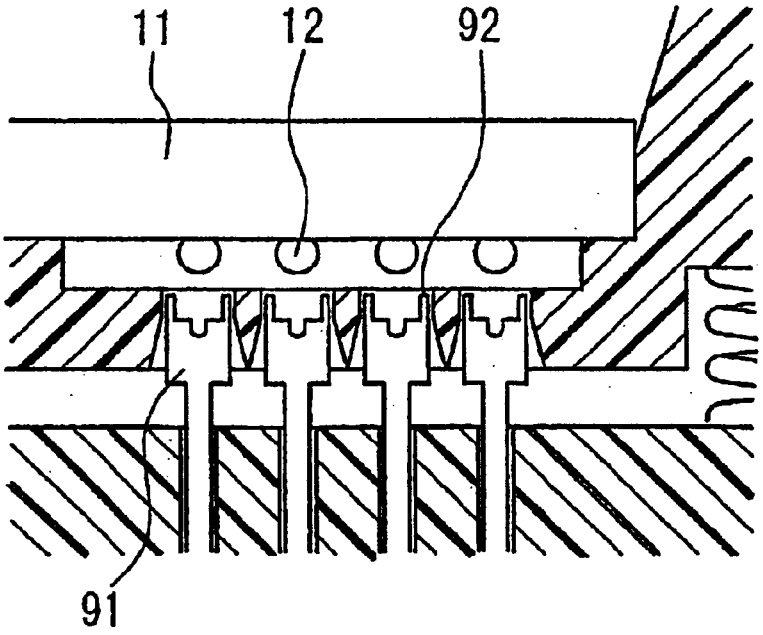
Figure 12:
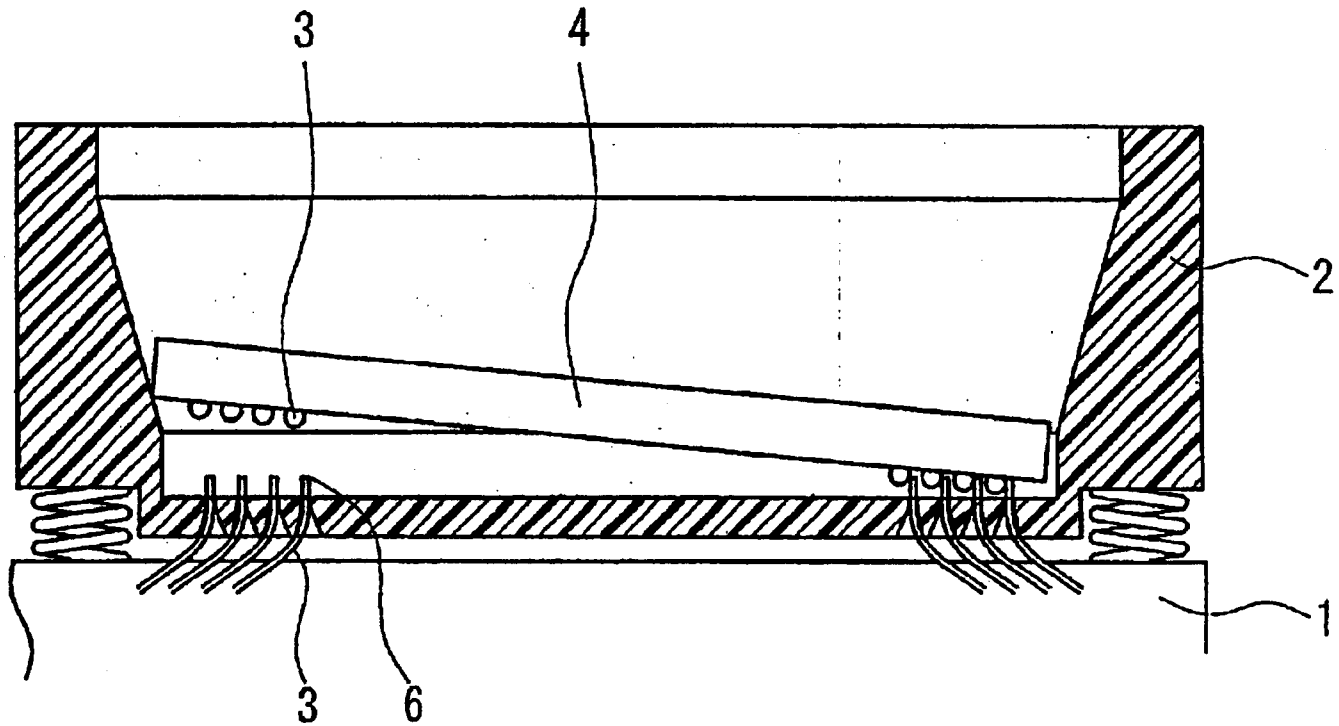
PRIOR ART FIG. 12
FIG. 12 is a cross section of a front elevational view showing an example of a conventional socket.

FIG. 11 shows a third preferred embodiment. In this embodiment, at least one protrusion 92 is provided on contact end 91 of the contact 90 and, when solder ball 12 softens and the contact end 91 has been cut into, protrusion 92 engages the lower surface of the package, thereby regulating the amount of bite into the solder ball.

In the socket according to the embodiments described, an example has been given by using a BGA device. It will be realized that the socket can also be used for semiconductor devices of the surface loading type such as CSP or LGA. In addition, the number, size, shape and material of the BGA device are not limited to those described in the above explanation. The shape of the terminal does not have to be globular or semi-globular but the profile can be square, cone or elliptical. Regarding the material for the terminals, metals other than solder may be used.

The shape of the contact at end 42 of the contact in the first preferred embodiment is V-shaped; however, other shapes may be used. For instance, a T shape may be used so that deformation of the solder ball would become flat. Alternatively, a U-shape or cone shape may be employed for the purpose of preventing possible deformation of the lowest point of the solder ball.

Regarding the contact regulating member, a plurality of contacts have been arranged in each slot. However, it is possible to form a hole for each contact. Without using a slot or a hole, moreover, an insulating film could be used for insulation or for the determination of the position. The engagement part of the contact has been engaged with a stop surface for regulating the position of the movable end of the contact. It is not limited to this, as long as there is provided a means capable of regulating the position of the movable end.

In the socket according to the described embodiments, a latch member has been provided on the side of each terminal face of the adaptor. However, a pair of latches may be provided at positions facing the adaptor. Moreover, a link mechanism has been used for driving the latch member; however, cam driving mechanism could also be used. It is not restricted to some specific mechanisms.

According to the invention which has been described above, where a contact regulating member is provided for regulating the position of the movable end of the contacts between the adaptor and the base member, the movable end of the contact will not protrude from the adaptor when loading the semiconductor device. Accordingly, the semiconductor device can be placed on the adaptor and the terminal of the semiconductor device will not be damaged. In view of the fact that the amount of protrusion of the movable end of the contact from the adaptor is regulated, it becomes possible to control the amount of deformation of the terminal of the semiconductor device to less than a certain value. Moreover, the amount of the protrusion of the contact can be adjusted by replacing the adaptor. The result is that one socket can cope with a plurality of semiconductor devices of different sizes, shapes and kinds.

Although the invention has been described with regard to certain preferred embodiments thereof, further variations and modifications will become apparent to those skilled in the art. It is, therefore, the intention that the appended claims be interpreted as broadly as possible in view of the prior art to include such variations and modifications.

What is claimed is:

1. A socket comprising:

(a) a base member, (b) a cover member movably mounted on the base member toward and away from the base member, (c) a plurality of contacts, each contact having a first end fixed to the base member, a movable second end and an elastically deformed portion between the first end and the second end, (d) a contact regulating member mounted on the base member, said contact regulating member regulating the plurality of contacts so that the movable second ends of the plurality of contacts have a selected fixed height of protrusion from the contact regulating member, and (e) an adaptor movably mounted toward and away from the regulating member between opposite extremities proximate to and removed from the contact regulating member, respectively, the adaptor having a seating surface for seating an electronic device, a plurality of through-holes formed through the adaptor and seating surface at locations corresponding to the plurality of contacts, with the plurality of through-holes being capable of guiding the movable second end of each contact, when said adaptor is at the extremity proximate to said contact regulating member, each movable second contact end protruding through the seating surface and each terminal of an electronic device placed on said adaptor being connected with the movable second end of a respective contact.

2. A socket according to claim 1 further comprising an expanded width portion formed on each contact near the movable second end, said contact regulating member has a plurality of slots at locations corresponding to the plurality of contacts fixed to said base member, and stop surfaces formed in said slots engageable with the expanded width portions of respective contacts.

3. A socket according to claim 1 in which each movable second end of the plurality of contacts is arranged in a respective through-hole of the adaptor without protruding from the seating surface of the adaptor when the adaptor is in the extremity removed from the contact regulating member.

4. A socket according to claim 1 in which the amount of the protrusion of the movable second end of each contact from the seating surface of the adaptor is maximized when the adaptor is in the extremity proximate to the contact regulating member.

5. A socket according to claim 1 in which the adaptor is removably mounted on the contact regulating member.

6. A socket according to claim 1 further comprising a latch member having a pressing part linked between the cover member and the base member which rotates with the movement of said cover member between a position of the cover proximate to the main base with the pressing part at a retracted position and, a position of the cover member at a location removed from the base member with said pressing part at a location where it is capable of pressing a semiconductor device disposed on the seating surface of the adaptor and moving the adaptor, the latch member rotating with a first fulcrum as the center during movement from the position of the cover proximate to the main base and, said latch member rotating with a second fulcrum as the center when moving the adaptor.

7. A socket according to claim 6 in which the radius of rotation of the pressing part about the first fulcrum is greater than the radius of rotation of the pressing part about the second fulcrum.

8. A socket according to claim 1 in which comprising:

(a) a base member, (b) a cover member movably mounted on the base member toward and away from the base member, (c) a plurality of contacts, each contact having a first end fixed to the base member, a movable second end and an elastically deformed portion between the first end and the second end, (d) a contact regulating member mounted on the base member for regulating the position of the movable ends of the plurality of contacts, said contact regulating member preloading each elastic deformation portion of the plurality of contacts, and (e) an adaptor movably mounted toward and away from the regulating member between opposite extremities proximate to and removed from the contact regulating member, respectively, the adaptor having a seating surface for seating an electronic device, a plurality of through-holes formed through the adaptor and seating surface at locations corresponding to the plurality of contacts, with the plurality of through-holes being capable of guiding the movable second end of each contact, when said adaptor is at the extremity proximate to said contact regulating member, each movable second contact end protruding through the seating surface and each terminal of an electronic device placed on said adaptor being connected with the movable second end of a respective contact.

9. A socket according to claim 1 in which the comprising:

(a) a base member, (b) a cover member movably mounted on the base member toward and away from the base member, (c) a plurality of contacts, each contact having a first end fixed to the base member, a movable second end and an elastically deformed portion between the first end and the second end, (d) a contact regulating member mounted on the base member for regulating the position of the movable ends of the plurality of contacts, and (e) an adaptor movably mounted toward and away from the regulating member between opposite extremities proximate to and removed from the contact regulating member, respectively, the adaptor having a seating surface for seating an electronic device, a plurality of through-holes formed through the adaptor and seating surface at locations corresponding to the plurality of contacts, with the plurality of through-holes being capable of guiding the movable second end of each contact, said seating surface of the adaptor comprising a first surface supporting an electronic device offset from a second surface in which the through-holes are located, when said adaptor is at the extremity proximate to said contact regulating member, each movable second contact end protruding through the seating surface and each terminal of an electronic device placed on said adaptor being connected with the movable second end of a respective contact.

10. A socket comprising:

(a) a base member (b) a cover member movably mounted on the base member toward and away from the base member, (c) a plurality of contacts each of which has an elastic deformed portion between a first end fixed to the base member and a movable second end, (d) an adaptor movable toward and away from the base member between opposite extremities proximate to and removed from the base member, the adaptor having a seating surface and a plurality of through-holes through the adaptor and the seating surface at locations corresponding to the contacts, (e) at least one latch member linked between the cover member and the base member and being engageable with a semiconductor device received on the seating surface to press down and move the adaptor toward the contacts, the latch member rotatable in linkage with movement of the cover member, the latch member being movable in a first segment of motion between a retracted position when the cover is proximate to the base member and a position in which the pressing part of the latch member is engageable with a semiconductor device disposed on the seating surface with the latch member rotating using a first fulcrum in the first segment of motion and in a second segment of motion between the position in which the pressing part of the latch member is engageable with a semiconductor and a position in which the adaptor is at the extremity proximate to the base member, the latch member rotating using a second different fulcrum in the second segment of motion.

11. A socket comprising:

(a) a base member, (b) a cover member movably mounted on the base member toward and away from the base member, (c) a plurality of contacts, each of which has an elastic deformed portion between a first end fixed to the base member and a movable second end, the contact having an engagement part a selected distance from the movable second end, (d) a contact regulating member having a plurality of slots at locations corresponding to said plurality of contacts on the base member, a stop surface formed in each said slot for engagement with a respective engagement part so that the movable second ends of the plurality of contacts have a selected protrusion height from the contact regulating means, (e) an adaptor movable toward and away from the contact regulating member between opposite extremities proximate to and removed from the contact regulating member, the adaptor having a seating surface, a spring member disposed between the adaptor and the contact regulating member urging the adaptor toward the removed extremity, a plurality of through-holes formed through the adaptor at locations corresponding to the slots of said contact regulating means, the plurality of through-holes serving to guide the movable second ends of the plurality of contacts respectively, and, (f) a latch member linked between the cover member and the base member being engageable with a semiconductor device received on the seating surface to press down and move the adaptor toward the contact regulating means from the extremity removed from the contact regulating member to the extremity proximate to the contact regulating member.

12. A socket according to claim 11 in which the latch member rotates in linkage with movement of the cover member, the latch member being movable in a first segment motion between a retracted position when the cover is proximate to the base member and a position in which the pressing part of the latch member is engageable with a semiconductor device disposed on the seating surface with the latch member rotating using a first fulcrum in the first segment of motion and in a second segment of motion between the position in which the pressing part of the latch member is engageable with a semiconductor and a position in which the adaptor is at the extremity proximate to the contact regulating member, the latch member rotating using a second different fulcrum in the second segment of motion.

13. A socket according to claim 12 in which the straight-line distance between said pressing part and said fulcrum is greater than the straight-line distance between said pressing part and said second fulcrum.

14. A socket according to claim 12 in which the straight-line distance between said pressing part and said first fulcrum is greater than the straight-line distance between said pressing part and said second fulcrum.

15. A socket according to claim 14 comprising a plurality of latch members with the pressing part of each latch member being capable of pressing a respective different side of the semiconductor device.

* * * * *